United States Patent [19]

Kato et al.

[11] 3,963,495

[45] June 15, 1976

[54] IMAGE-RECEIVING ELEMENT FOR SILVER SALT DIFFUSION TRANSFER WITH LAYER OF MONOACRYLATES OR MONOMETHACRYLATES OF POLYHYDRIC ALCOHOLS

[75] Inventors: Kazunobu Kato; Shinji Sakaguchi, both of Minami-ashigara, Japan

[73] Assignees: Fuji Photo Film Co., Ltd., Japan; National Patent Development Corporation, New York, N.Y.

[22] Filed: Mar. 20, 1974

[21] Appl. No.: 453,104

[30] Foreign Application Priority Data

Mar. 20, 1973 Japan ..... 48-31355

[52] U.S. Cl. ..... 96/76 R; 96/29 R; 96/119 R; 428/451; 428/500; 428/538

[51] Int. Cl.[2] ..... G03C 1/48; G03C 5/54; B27K 3/15; B41M 1/18

[58] Field of Search ..... 96/76 R, 119 R; 428/500, 523, 538, 451

[56] References Cited

UNITED STATES PATENTS

| | | | |
|---|---|---|---|
| 3,552,971 | 1/1971 | Takenaka et al. | 96/76 R |
| 3,592,647 | 7/1971 | Blake et al. | 96/29 L |
| 3,607,269 | 9/1971 | Young | 96/76 R |
| 3,749,578 | 7/1973 | Ohkubo et al. | 96/76 R |
| 3,832,175 | 8/1974 | Kemp | 96/29 L |

*Primary Examiner*—Mary F. Kelley
*Assistant Examiner*—Richard L. Schilling
*Attorney, Agent, or Firm*—Cushman, Darby & Cushman

[57] ABSTRACT

An image-receiving material for silver salt diffusion transfer process having at least two layers wherein (I) a polymer layer containing diffusible compound, which can change the property of silver image formed in a binder layer containing silver deposition nuclei, and (II) the binder layer containing silver deposition nuclei on said polymer layer are provided on support, said polymer layer comprising at least one water insoluble hydrophilic polymer selected from the group consisting of homopolymers, copolymers and graft polymers of monoacrylates of polyhydric alcohols and homopolymers, copolymers and graft polymers of monomethacrylates of polyhydric alcohols.

14 Claims, 1 Drawing Figure

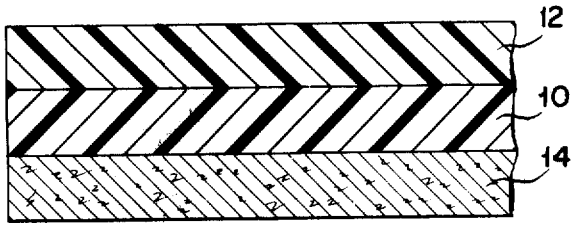
12
10
14

IMAGE-RECEIVING ELEMENT FOR SILVER SALT DIFFUSION TRANSFER WITH LAYER OF MONOACRYLATES OR MONOMETHACRYLATES OF POLYHYDRIC ALCOHOLS

This invention relates to an image-receiving material for silver salt diffusion transfer process.

Hitherto, there has been known the diffusion transfer photographic process in which silver salt such as silver halide is used. In such photographic process, a photographic sensitive material, which is formed by dispersing finely divided particles of photosensitive silver salt such as silver halide in hydrophilic binder such as gelatin, polyvinyl alcohol, carboxy methyl cellulose, polyvinyl pyrrolidone, methyl cellulose and the like and coating the resulting dispersion on a support such as paper and baryta-coated paper or films of high molecular materials such as polyethylene terephthalate, cellulose diacetate, triacetate or nitrate, polycarbonate, polyvinyl chloride and the like, is imagewise exposed and contacted to a treating liquid containing developer, whereby the exposed silver halide in the sensitive layer is reduced (developed) to non-diffusible silver. At the same time or thereafter, the contact of said sensitive material to a water soluble silver complex-forming agent leads to the reaction between the unexposed silver halide and said water soluble silver complex-forming agent to form a water soluble silver complex compound. When an image-receiving material having a layer (image-receiving layer) containing as dispersion a substance (silver deposition nuclei, so-called physical development nuclei), which acts as catalyst for the reduction of said water soluble silver complex compound, in a hydrophilic binder is contacted closely to said sensitive layer, the silver complex compound formed in the sensitive layer is diffused by the treating liquid to move from the sensitive layer to the image-receiving layer and reduced to silver in the image-receiving layer by the action of developer nuclei. Thus, as a whole, a silver image is formed in such manner that the image is transferred from the sensitive layer to the image-receiving layer. From such technical concept, the photographic process as mentioned above is called as silver salt diffusion transfer photographic process.

There have been many studies previously relating to the image-receiving material used in silver salt diffusion transfer photography. For example, as silver deposition nuclei, there are used in general water insoluble metal sulfides, metal selenides or the colloids of heavy or noble metals, where it is desirable that silver deposition nuclei are of large activity. For instance, there is described in the U.S. Pat. No. 2,698,237 a process wherein a water soluble metal salt and a water soluble sulfide are mixed in a finely divided silica to form the precipitation of water insoluble metal sulfide resulting in silver deposition nuclei of high activity. The U.S. Pat. No. 3,671,241 describes also an image-receiving material which is prepared by providing silver deposition nuclei to an alkali-impermeable polymer by the vacuum deposition dissolving in a solvent for said polymer, coating the resulting solution on a support, drying and then rendering the surface layer of said polymer layer alkali-permeable by chemical treatment such as hydrolysis.

We have found previously an image-receiving material for silver salt diffusion transfer process which was prepared by hydrolysing the cellulose ester layer and, at the same time of or after hydrolysis, providing silver deposition nuclei to the hydrolysed layer. However, silver images formed in the thus obtained image-receiving material were disadvantageously easily discolored or faded on storage.

As a process for improving the above disadvantage, there is described a process for coating the surface of silver image obtained with a water soluble polymer solution containing alkaline neutralizing component in the U.S. Pat. Nos. 3,529,962; 3,533,789 and 3,533,790 and the British Patent No. 1,164,642. According to the process however, it took a considerable time to dry completely the surface coated with the aqueous solution of polymer, during which the surface was so sticky that a print might be not contacted thereto and fingerprints and dusts were adhered often thereto. Further, it is troublesome to coat additionally the silver image with such solution.

An image-receiving material is disclosed in the U.S. Pat. No. 3,607,269 wherein (I) a cellulose ester, polyvinyl ester or polyvinyl acetal layer, which contains such compound that may be diffusible and change the property of silver image and which is hydrolysable and rendered hydrolytically alkali-permeable and (II) a regenerated cellulose layer containing silver deposition nuclei thereon are provided on support. As compounds which are diffusible and may change the property of silver image, organic mercapto compounds are described. In this case, after the diffusion transfer process, the mercapto compound in the layer (I) diffuses gradually into the layer (II) to protect the silver image and prevent the discoloration and fading thereof.

The provision of cellulose ester layer according to the U.S. Pat. No. 3,607,269 is performed by dissolving in limited kinds of organic solvents such as a mixed solvent of methanol and methylene chloride, acetone and others, coating on a support by means of suitable method such as roller-coating, dipping etc. and drying. However, the procedure as above leads disadvantageously to a high manufacturing cost because the organic solvent evaporated after coating effects often harmfully to the human health so that it is necessary to recover it. The use of polyvinyl ester or polyvinyl acetal instead of cellulose ester gives the same result. It is necessary to protect the image formed in the layer (II) because the mercapto compound remains in the layer (I) during the storage of undeveloped image-receiving material and during the diffusion transfer treatment and penetrates from the layer (I) to (II) after the formation of silver image by the treatment. When the diffusion of mercapto compound from the layer (I) to (II) before the perfect completion of diffusion transfer treatment, the development is suppressed and the optical density of transferred silver image on the image-receiving material is reduced on the whole. Further, a too late diffusion of mercapto compound takes place the discoloration and fading of image before the silver image is protected by the mercapto compound. And, when cellulose esters are used, though the optical density of silver image transferred is sufficiently high, the stability of silver image is not sufficient and the discoloration and fading take place easily on storage.

Accordingly, an object of this invention is to provide an improved image-receiving material for silver salt diffusion transfer process.

Another object of this invention is to provide an image-receiving material for silver salt diffusion transfer process, said material being able to be manufactured in safety and simple steps.

Still further object of this invention is to provide an image-receiving material for silver salt diffusion transfer process, whereby the discoloration or fading does not substantially take place in images.

In the image-receiving material for silver salt diffusion transfer process according to this invention, (I) a polymer layer containing diffusible compound, which can change the property of silver image formed in a binder layer containing silver deposition nuclei, and (II) the binder layer containing silver deposition nuclei on said polymer layer are provided on a support, said polymer layer comprising at least one water insoluble hydrophilic polymer selected from the group consisting of homopolymers, copolymers and graft polymers of monoacrylate of polyhydric alcohols and homopolymers, copolymers and graft polymers of monomethacrylate of polyhydric alcohols. The feature of this invention consists in the use of hydrophilic polyacrylate or polymethacrylate of monoacrylate or monomethacrylate of polyhydric alcohols as binder for the layer (I), whereby the foregoing disadvantages in the prior art can be removed. Thus, in the first place, hydrophilic polyacrylates to be used in this invention are insoluble in water but soluble in organic solvents and mixed solvents of water and organic solvent (methanol, ethanol, isopropanol, acetone etc.), so that the use of said mixed solvent may reduce the amount of organic solvent used. Secondly, when hydrophilic polyacrylates used in this invention are used as binder for the layer (I), the optical density of silver image transferred is high with a high stability of silver image, so that the discoloration and fading occur very hardly on storage.

The cellulose ester, polyvinyl ester and polyvinyl acetal described in the U.S. Pat. No. 3,607,269 are polymers which are rendered hydrolytically alkali-permeable. However, quite different from these polymers in the physical properties, the hydrophilic polyacrylates according to this invention are hydrolyzed very difficultly and are characteristically alkali-permeable in themselves even though not hydrolyzed.

For a fuller understanding of the nature and objects of the invention, reference should be had to the following greater detailed description, taken in connection with the accompanying drawing, wherein:

The FIGURE is an exaggerated cross-sectional view of an image-receiving material representative of this invention.

Being water-insoluble, hydrophilic polymers used in this invention can absorb large amounts of water due to alkali-permeability and water-permeability thereof. The polymers are concretely homopolymers, copolymers and graft polymers of a monoacrylate and a monomethacrylate of polyhydric alcohols.

There is no particular limitation on the polyhydric alcohol used so long as the resulting polymer is alkali and water permeable. However, preferred polyhydric alcohols used in this invention, which can be aliphatic or aromatic in nature, can be defined as compounds having at least two aliphatic hydroxy groups, preferably compounds having from 2 to 5 aliphatic hydroxy groups, and having from 2 to 12 carbon atoms. There are, for example, diols such as ethylene glycol, (eg. diethylene glycol, triethylene glycol etc.) polyethyleneglycol, polyethylene oxide, polypropylene oxide, polybutylene oxide, polycyclohexene oxide, polystyrene oxide, polyoxetane, polytetrahydrofuran, cyclohexane diol, xylylene diol, di-($\beta$-hydroxyethoxy)-benzene; polyols such as glycerine, diglycerine, trimethylol propane, triethylolpropane, pentaerythritol, and the like.

Specific examples of the monoacrylates and monomethacrylates of polyhydric alcohol include 2-hydroxy ethyl acrylate, 2-hydroxy propyl acrylate, 3-hydroxy propyl acrylate, 4-hydroxybutyl acrylate, 5-hydroxy pentyl acrylate, 2,2-dimethyl-3-hydroxy propyl acrylate, diethylene glycol monoacrylate, triethyleneglycol monoacrylate, dipropyleneglycol monoacrylate, grycerol monoacrylate, trimethylol propane monoacrylate, pentaerylthritol monoacrylate, 2-hydroxy ethyl methacrylate, 2-hydroxy propyl methacrylate, 3-hydroxy propyl methacrylate, 4-hydroxybuthyl methacrylate, 5-hydroxy pentyl methacrylate, 2,2-dimethyl-3-hydroxy propyl methacrylate, diethylene glycol monomethacrylate, triethylene glycol monomethacrylate, dipropylene glycol monomethacrylate, grycerol monomethacrylate, trimethylol propane monomethacrylate, pentaerylthritol monomethacrylate.

As comonomers, used for components of hydrophilic polymers used in this invention, there are addition polymerizable unsaturated compounds such as acrylic esters, acrylamides, esters of methacrylate, methacrylamides, allyl compounds, vinyl ethers, vinyl esters, styrenes, crotonic acid esters, which are selected from the compounds having one additional polymerizing unsaturated bond. They are concretely, for example, acrylic esters such as alkylacrylate (for example, methyl acrylate, ethyl acrylate, propyl acrylate, butyl acrylate, amyl acrylate, ethyl hexyl acrylate, octyl acrylate, octyl-t-acrylate, chloroethyl acrylate, 2,2-dimethyl hydroxy propyl acrylate, 5-hydroxy pentyl acrylate, trimethylol propane acrylate, pentaerythritol monoacrylate, glycidyl acrylate, furbenzyl acrylate, methoxy benzyl acrylate, furfuryl acrylate, tetrahydrofurfuryl acrylate, etc.), aryl acrylate (for example phenyl acrylate): esters methacrylate such as alkyl methacrylate (for example, methyl methacrylate, ethyl methacrylate, propyl methacrylate, isopropyl methacrylate, amyl methacrylate, hexyl methacrylate, cyclohexyl methacrylate, benzyl methacrylate, chlorobenzyl methacrylate, octyl methacrylate, 4-hydroxy buthyl methacrylate, 5-hydroxy pentyl methacrylate, 2,2-dimethyl-3-hydroxy propyl methacrylate, trimethylolpropane monomethacrylate, pentaerylthritol monomethacrylate, glycidyl methacrylate, furfuryl methacrylate, tetrahydrofurfuryl acrylate, etc.), aryl methacrylate (for example, phenyl methacrylate, cresyl methacrylate, naphthyl methacrylate, etc.): acrylamides such as acrylamide, N-alkyl acrylamide (as said alkyl groups there are such ones as a methyl group, an ethyl group, a propyl group, a t-butyl group, a heptyl group, an octyl group, a cyclohexyl group, a benzyl group, a hydroxy ethyl group, etc.), N-aryl acryl amide (as said aryl groups there are such ones as a phenyl group, tolyl group, a nitrophenyl group, a naphthyl group, a hydroxy phenyl group, etc.), N,N-dialkyl acrylamide (as said alkyl groups there are such ones as a methyl group, an ethyl group, a buthyl group, an isobuthyl group, an ethyl hexyl group, a cyclohexyl group, etc.), N,N-diaryl acrylamide (as said aryl groups there is such one as a phenyl group), N-methyl-N-phenyl acrylamide, N-hydroxy ethyl-N-methyl acrylamide, N-2-acetoamide ethyl-N-acetylacrylamide, etc: methacryl amides such as methacryl amide, N-alkyl methacryl amide (as said alkyl groups there are such ones as a methyl group, an ethyl group, a t-butyl group, an ethyl hexyl group, a hydroxy ethyl group, a cyclohexyl group, etc.), N-aryl methacryl amide (as said aryl group there is such one as a phenyl group.) N,N-dialkyl acrylamide (as said alkyl groups there are such ones as an ethyl group, a propyl group, a butyl group.), N,N-diaryl methacrylamide, (as said aryl groups there is such one as a phenyl group.), N-hydroxy ethyl-N-methyl methacrylamide, N-methyl-N-phenyl methacrylamide, N-ethyl-N-phenyl methacrylamide: allyl compounds such as allyl esters (for example, allyl acetate, caproic acid allyl, caprylic acid allyl, lauric acid allyl, palmitic acid allyl, allyl stearate, allyl benzoate, allyl acetoacetate, allyl lactate.), allyl oxyethanol: vinyl ethers such as alkyl vinyl ether (for example, hexyl vinyl ether, octyl vinyl ether, decyl vinyl ether, ethyl hexyl vinyl ether, methoxy ethyl vinyl ether, methoxy ethyl vinyl ether, ethoxy ethyl vinyl ether, chloroethyl vinyl ether, 1-methyl-2,2-dimethyl propyl vinyl ether, 2-ethyl butyl ether, hydroxy ethyl vinyl ether, diethylene glycol vinyl ether, diethyl amino ethyl vinyl ether, buthyl amino ethyl vinyl ether, benzil vinyl ether, tetrahydro furfuryl vinyl ether, etc.), vinyl aryl ethers (for example, vinyl phenyl ether, vinyl tolyl ether, vinyl chlorophenyl ether, vinyl-2,4-dichlorophenyl ether, vinyl naphthyl ether, vinyl anthranil ether, etc.): vinyl esters, such as vinyl butyrate, vinyl isobutyrate, vinyl trimethyl acetate, vinyl diethyl acetate, vinyl valerate, vinyl caproate, vinyl chloroacetate, vinyl dichloroacetate, vinyl methoxy acetate, vinyl phenyl acetate, vinyl acetacetate, vinyl lactate, vinyl-$\beta$-phenyl butyrate, vinyl cyclohexyl carboxylate, vinyl benzoate, vinyl salicylate, vinyl chlorobenzoate, vinyl tetrachlorobenzoate, vinyl naphthoate: styrenes, such as styrene, alkylstyrene (for example, methyl styrene, dimethyl styrene, trimethyl styrene, ethyl styrene, diethyl styrene, isopropyl styrene, butyl styrene, hexyl styrene, cyclohexyl styrene, decyl styrene, benzyl styrene, chloromethyl styrene, trifluoromethyl styrene, ethoxy methyl styrene, acetoxy methyl styrene, etc.), alkoxy styrene (for example, methoxy styrene, 4-methoxy-3-methyl styrene, dimethoxystyrene, etc.), halogen styrene (for example, chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethyl styrene, 4-fluoro-3-trifluoromethyl styrene, etc.): esters crotonate, such as alkyl crotonate (for example, butyl crotonate, hexyl crotonate, glycerol monocrotonate, etc.): dialkyls itaconate (for example, dimethyl itaconate, diethyl itaconate, dibutyl itaconate, etc.): dialkyls maleate or fumarate (for example, dimethyl maleate, dibutyl fumarate, etc.): acrylonitrile: methacrylonitrile, etc. Additionally, additional polymerizing unsaturated compounds capable of copolymerizing with the monoacrylates or monomethacrylates of polyhydric alcohol can generally be used.

Monoacrylate and/or monomethacrylate of polyhydric alcohol are desirable to be more than 50 %, more desirably more than 60 % in a molar ratio of copolymerization. As comonomers, not only one kind but more than two kinds can be used. Further, copolymers of monoacrylate monomethacrylate of said polyhydric alcohols can be of course used. The molecular weight of said homopolymers and copolymers used is in general more than 10,000, preferably 50,000 – 600,000.

Graft polymers are those obtained by grafting said hydrophilic acrylate or methacrylate monomers to gelatine, polyvinyl alcohol, polyacrylamide, polymethacrylamide, carboxyethyl cellulose, starch and the like.

For manufacturing said homopolymers, copolymers and graft polymers, 0.05 – 20 %, preferably 0.1 – 1 % of cross-linking agent may be used if desired, based on the monomer. As crosslinking agents, there are mentioned for example diacrylates or dimethacrylates of polyhydric alcohols such as ethyleneglycol diacrylate, ethyleneglycol dimethacrylate, propyleneglycol diacrylate, propyleneglycol dimethacrylate, diethyleneglycol diacrylate, diethyleneglycol dimethacrylate, glycerol dimethacrylate; N,N'-methylene-bis-acrylamide and the like.

Said polymers can be manufactured in a common solution polymerization or graft polymerization process, the condition of which is not critical. As the solvent for the polymerization, it is preferable to use aprotic solvent such as hexamethylphosphoramide, dimethylformamide, formamide, pyridine, dimethylsulfoxide, methanol, ethanol, tert-buthanol, diethylene glycol, 2-methoxyethanol, formic acid, acetic acid, dioxane and the like. The polymerization is carried out in general at 20° – 150°C, preferably 20° – 90°C. The polymerization reaction is performed in general with 0.05 – 2 % by weight of radical catalyst, based on the polymerizable monomer. As representative catalysts, there are mentioned azobis compounds, peroxides, Redox catalysts; for example, potassium persulfate, tert-butyl peroctoate, benzoyl peroxide, isopropyl percarbonate, 2,4-dichlorobenzoyl peroxide, methyl ethyl ketone perioxide, cumene hydroperoxide, dicumyl peroxide, azobisisobutyl peroxide and the like.

Examples for the synthesis of said polymers are described as follows.

SYNTHESIS 1

Homopolymer of 2-hydroxyethyl methacrylate 200 g of 2-hydroxyethyl methacrylate were added to a mixed solvent of 550 ml water and 550 ml ethanol. After 1 g of potassium persulfate and 1 g of sodium hydrogen sulfite were added thereto, oxygen was excluded by substituting with nitrogen and the mixture was stirred at 60°C for 4 hrs. The filtered reaction solution was added to a 10-fold excess of cold water to precipitate, thereby the polymer was purified and dried in a vacuum desiccator. Yield: 160 g; mean molecular weight: 350,000.

SYNTHESIS 2

Copolymer of 2-hydroxyethyl methacrylate and acrylamide 176 g Of 2-hydroxyethyl methacrylate and 24 g of acrylamide were added to a mixed solvent of 550 ml of water and 550 ml ethanol. After 0.8 g of potassium persulfate and sodium hydrogen sulfite were added thereto, the reaction vessel was purged with nitrogen and the reaction mixture was stirred at 70°C for 3 hrs, whereupon it was placed in a dialysis diaphragm, subjected to dialysis for 15 – 20 hrs with running water and dried by means of lyophilizer. Yield: 197 g; mean molecular weight: 200,000.

SYNTHESIS 3

Homopolymer of 3-hydroxypropyl methacrylate 300 g Of 3-hydroxypropyl methacrylate were added to a mixed solvent of 400 ml water and 800 ml ethanol.

1 g Of azobisisobutylonitrile was added thereto and the reaction vessel was purged with nitrogen. The reaction solution was stirred for 3 hrs while keeping the temperature at 70°C. The filtered reaction solution was entered to a 10-fold excess of cold water to precipitate the polymer and the resulting mass was dried in a vacuum desiccator. Yield: 260 g; mean molecular weight: 570,000.

SYNTHESIS 4

Copolymer of 2-hydroxyethyl acrylate and 2-hydroxyethyl methacrylate

In the same manner as in Synthesis 2, 94 g of 2-hydroxyethyl acrylate and 106 g of 2-hydroxyethyl methacrylate were copolymerized. Yield of copolymer: 186 g; mean molecular weight: 230,000.

SYNTHESIS 5

Copolymer of 2-hydroxyethyl methacrylate and methyl methacrylate 149 g Of 2-hydroxyethyl methacrylate and 81 g of methyl methacrylate were added to a mixed solvent of 500 ml water and 1500 ml methanol. After 1.5 g of benzoyl peroxide were added, the oxygen in the reaction vessel was purged with nitrogen and the reaction mixture was stirred at 60°C for 4 hrs. The copolymer was purified and dried in the same manner as in Synthesis 3. Yield: 430 g; mean molecular weight: 480,000.

SYNTHESIS 6

Hydroxyethyl cellulose graft polymer of 2-hydroxyethyl methacrylate 50 g Of hydroxyethyl cellulose were added to a mixed solvent of 750 ml water and 150 ml ethanol and dissolved at 60°C. After purging with nitrogen, the temperature of solution was raised to 75°C and the reaction mixture was stirred for 4 hrs while 0.3 g of benzoyl peroxide dispersed in 50 g of 2-hydroxyethyl methacrylate was added dropwise from a dropping funnel. The reaction mixture was placed in a dialysis diaphragm, dipped in a running water to subject to dialysis for 20 hrs and then dried by means of lyophilizer. Yield: 88 g.

SYNTHESIS 7

Gelatine graft polymer of 2-hydroxyethyl methacrylate 20 g Of gelatine were dissolved at 60°C in 100 ml of glycerine/water (1:1 by volume) and 300 ml of ethanol/water (3:1 by volume) were added gradually thereto with stirring. 1 g Of benzoyl peroxide and 20 g of 2-hydroxyethyl methacrylate were added in the course of about 10 min and heated to 80°C. The reaction was completed in 2 hrs and the reaction mixture was packed in a cellophane film, subjected to dialysis for 24 hrs with running water and then lyophilized. Yield: 37 g; gelatine content: 54 % by weight.

SYNTHESIS 8

Copolymer of 2-hydroxyethyl methacrylate and n-butyl methacrylate 157.1 g Of 2-hydroxyethyl methacrylate and 42.9 g of n-butyl methacrylate were fed to a 200 ml three-neck flask and 400 ml of ethanol, 300 ml of water and 40 ml of isopropanol were added thereto. 4.1 g Of potassium persulfate and 1.6 g of sodium hydrogen sulfite were dissolved in 100 ml of water and added with stirring. After stirring for 5 hrs while the temperature was kept at 60°C, the reaction mixture was poured into a 10-fold excess of cold water with stirring and the precipitate was dried. Yield: 170 g; ultimate viscosity: 0.61.

Hydrophilic acrylate polymers according to this invention are preferably dissolved in a suitable solvent selected from the group of methanol/water, ethanol/water, acetone/water and methyl ethyl ketone/water mixture and the like. Further, three-component solvents can be used. Either one or more said hydrophilic acrylate polymers can be used and other polymers, organic plasticizers and inorganic substances such as barium sulfate can be used. Further, the hydrophilic acrylate polymer can be used in the form of one or more layers and coated on other polymer layer.

As compounds which are diffusible and can change the property of silver image, there are mentioned for example mercapto compounds (including their tautomers), imino compounds and iodine compounds, which are especially effective for improving the storage stability of silver image. In particular, it has been already known that both mercapto and imino compounds have an excellent property to prevent the silver image from discoloration and fading. In the present invention, many kinds of known mercapto and imino compounds can be used without restricting this invention due to the kind of said compounds.

However, it is necessary that the mercapto and imino compounds in this invention are essentially diffusible because the effect according to this invention can be attained by the fact that the mercapto and imino compound is rendered diffusible by means of alkali in liquid developer after development and diffuses to the image-receiving layer to protect the silver image.

Some examples of compounds according to this invention will be mentioned as follows, to which this invention is not restricted:

1. Unsubstituted and 1-alkyl- or -aryl-substituted imidazolidinethiones,
2. Unsubstituted and 1-alkyl- or -aryl-substituted 2-mercapto-imidazoles,
3. Unsubstituted and 4- and/or 5-substituted 3-mercapto-4H-1,2,4-triazoles (substituent: alkyl or aryl),
4. Unsubstituted and 5-alkyl-, -aryl- or -nitro-substituted 2-mercaptobenzimidazoles,
5. Unsubstituted and 1-alkyl- or -aryl-substituted 5-mercapto-1H-tetrazoles,
6. Unsubstituted and 4- and/or 6-substituted 2-mercapto-pyrimidines (substituent: alkyl, hydroxyl or mercapto),
7. Unsubstituted and 3- and/or 6-substituted 1,3-dimercapto-3H,6H-2,3a,5, 6a-tetrazapentalenes (substituent: alkyl or aryl),
8. Unsubstituted and 5-alkyl-, -nitro- or -halogeno-substituted benztriazoles,
9. Unsubstituted and 5-alkyl-, -nitro- or -halogeno-substituted 1H-imidazoles,
10. Unsubstituted and 5-alkyl-, -nitro- or -halogeno-substituted benzimidazoles,
11. Unsubstituted and 2- and/or 5-substituted benzothiazoles (2-position substituent: hydroxy or mercapto; 5-position substituent: alkyl or nitro),
12. Cysteine,
13. Unsubstituted and 6-alkyl-, -hydroxy- or -mercapto-substituted 4-mercapto-1,3,3a,7-tetraazaindenes.

In these compounds, the alkyl radical has preferably less than 12 carbon atoms and may be straight or branched. Compounds having more than 13 carbon atoms show a reduced diffusion. As aryl radicals, there are mentioned for example phenyl, substituted phenyl such as tolyl, and others.

Additionally, various mercapto compounds described in British Pat. No. 1,149,922 also can be used suitably in this invention.

Specific examples of such compounds include 2-imidazoli-dinethion, 1-ethyl-2-imidazolidinethion, 1,3'-methyl phenyl-2-imidazolidinethion, 2-mercaptoimidazole, 3-mercapto-4H-1,2,4-triazole, 4-phenyl-3-mercapto-4H-1,2,4-triazol, 5-propyl-2-mercaptobenzimidazole, 5-phenyl-2-mercaptobenzimidazole, 5-nitro-2-mercaptobenzimidazole, 2-mercaptobenzimidazole, 1-ethyl-5-mercapto-1H-tetrazol, 1-phenyl-5-mercapto-1H-tetrazole, 5-mercapto-1H-tetrazole, 2-mercaptopyridine, 4-ethyl-2-mercaptopyridine, 4-hydroxy-2-mercaptopyrimidine, 2,4-dimercaptopyridine, 6-methyl-2-mercaptopyridine, 6-hydroxy-2-mercaptopyrimidine, 2,6-dimercaptopyrimidine, 4-ethyl-6-ethyl-2-mercaptopyrimidine, 4-methyl-6-hydroxy-2-mercaptopyrimidine, 4-nonyl-2,6-dimercaptopyrimidine, 4-hydroxy-2,6-dimercaptopyrimidine, 4,6-dihydroxy-2-mercaptopyrimidine, 1,4-dimercapto-3H,6H-2,3a,5,6a-tetrazapentalene, 3,6-diphenyl-1,4-dimercapto-3H,6H-2,3a,5,6a-tetrazapentalene, benzotriazole, 6-nitrobenzotriazol, 6-chlorobenzotriazol, 6-bromobenzotriazol, 6-octyl-benzotriazol, 1H-indazole, 5-nitro-1H-indazole, 5-chloro-1H-indazole, 5-bromo-1H-indazole, 5-iodo-1H-indazole, 5-methyl-1 H-indazole, benzimidazole, 5-nitrobenzimidazole, 5-methylbenzimidazole, 2-mercaptobenzothiazole, 2-mercaptobenzimidazole, cysteine, 4-mercapto-1,3,3a,7-tetraazaindene, 6-methyl-4-mercapto-1,3,3a,7-tetraazaindene, 6-nonyl-4-mercapto-1,3,3a,7-tetraazaindene, 6-lauryl-4-mercapto-1,3,3a,7-tetraazaindene, etc.

As the organic mercapto compounds or imino compounds included in this invention, there are compounds (precursors) which form mercapto compounds or imino compounds, such as one described above, upon dissociation or decomposition under alkaline conditions, and the metallic salts of organic mercapto compounds or imino compound are also included.

As mercapto compound precursors, there are such ones as 2-morpholino methyl-4-phenyl-1,2,4-triazol-3-thion, 1-morpholino methyl-4-phenyltetrazol-5-thion, 2-phenyl-4-hydroxymethyl-1,2,4-triazol-3-thion, 2-acetylthioimidazole, 5-ethoxycarbonyl-thio-3-methyl-4-phenyl-1,2,4-triazol, 5-ethoxycarbonylthio-4-phenyltetrazol, α-thioctic acid, cystine, 3-morpholino methyl benzothiazoline-2-thion, 5-methyl-3-morpholinomethyloxazolidine-2-thion, 1-morpholinomethyl-4(4'-methyl phenyl) tetrazol-2-in-5-thion, 4-piperidinomethyl-1-phenyltetrazol-2-in-5-thion, 4-morpholinomethyl-2-phenyl-1,3,4-oxadiazole-2-in-5-thion, 3-piperizinomethyl-4-thiazolidine-2-thion, 2-amino-4-morpholino-methyl-1,3,4-thiazole-2-in-5-thion, 4-methyl-3-morpholinomethyl-4-thiazoline-2-thion, etc.

As metallic salts of organic mercapto compounds, salts or complex compounds of said mercapto compounds with various metal ions can be used.

As metal ions there are such ones as gold, lead, platinum, cadmium, zino, iron, cobalt, sodium, potassium, calcium, lithium, balium, etc.

The amounts of addition to layer (I) (10 in FIG.) of these diffusible compounds capable of changing the proper of silver images are usually from about $10^{-6}$ to $10^{-2}$ mol/m$^2$, preferably $10^{-5}$ to $5 \times 10^{-3}$ mol/m$^2$, though effective amounts are different depending on the kinds of compounds.

As binders of layer (II) (12 in FIG.), various film-forming, hydrophilic organic polymers and inorganic colloidal materials can be used. As film-forming, hydrophilic organic polymers, there are such natural polymers as gelatin, casein, and such synthetic polymers as polyvinyl alcohol, cellulose, carboxymethylcellulose, methylcellulose. As film-forming, hydrophilic inorganic colloidal materials, there are colloidal silica and colloidal alumina.

As silver deposition nuclear materials, there are such heavy metals as zinc, mercury, lead, cadmium, iron, chromium, nickel, tin, cobalt, copper, and such noble metals as palladium, platinum, silver, gold, or sulfides, selenides, tellurides thereof. These silver deposition nucleus substances are obtained by reducing the corresponding metal ions to form a dispersion of metal colloid, or by mixing a solution of metal ion with a solution of soluble sulfide, selenium or tellurium compound to form a colloid dispersion of water insoluble metal sulfide, selenide or telluride. In order to obtain an image-receiving material which provides images of preferred tone, these silver deposition nuclei are contained in general in an amount of $10^{-9}$ to $10^{-6}$ g/cm$^2$, preferably $10^{-8}$ to $10^{-7}$ g/cm$^2$ on the image-receiving layer.

The thickness of layer (I) 10 and layer (II) 12 each is from about 0.1 to 20 μ and from about 0.1 to 10 μ, preferably 0.5 to 10 μ and 0.5 to 5 μ respectively. For the layer (I) 10 and layer (II) 12 of too small thickness, the function of each layer cannot be displayed sufficiently. On the other hand, for layers of too large thickness, a large amount of treatment liquid remains in the layer (I) and (II) to yield stains resulting in a poor preservation property of image.

As support 14 on which said layer (I) 10 and (II) 12 are carried, there are described paper, baryta coated paper, pigment (such as titanium white)-coated paper; paper coated with high molecular substances such as cellulose acetate, cellulose nitrate, polyvinyl butyral, polyvinyl formal, cellulose butyrate, cellulose acetate butyrate, cellulose propionate, polyethylene, polystyrene and the like by the lacquer or emulsion coating method; films of high molecular substances such as polyethylene terephthalate, cellulose diacetate, cellulose triacetate, nitrocellulose, polycarbonate, polyvinyl chloride and the like; All kinds of supports, which have been used previously in photography, can be used.

In another embodiment according to this invention, an alkali-permeable polymer layer can be provided between the layer (I) 10 and (II) 12 for the purpose to control the diffusion velocity of mercapto compound etc. to the layer (II). An alkali-permeable polymers used for this purpose, many kinds of polymers can be used, for example, gelatin, polyvinyl alcohol, cellulose acetate phthalate and alkali metal salts thereof, alkali metal salts of polyacrylic or polymethacrylic acid. Further, homopolymers, copolymers and graft polymers of acrylate or methacrylate of polyhydric alcohols, which are used in this invention, can be used. A thin layer of alkali-permeable or alkali soluble polymer substances as stripping layer may be provided to the surface of layer (II) in the image-receiving material according to this invention as in previous common image-receiving materials.

As gelatine-silver halide sensitive materials which may be used in this invention, there are used silver chloride, silver bromide, silver iodide, silver chlorobromide, silver iodobromide and silver chloroiodobromide emulsion, preferably silver bromide and iodobromide for the use as photographic material. The mean particle size of these silver halide is in general 0.1 – 10 μ. Additives such as optical sensitizer, chemical sensitizer, antifoggant, gelatin-hardener, surface active agents are added depending on the purpose desired. In some cases, a developing agent for development may be added previously to the silver halide sensitive material.

The image-receiving material according to this invention can be applied in many forms. As one example, there is mentioned one known as peal apart type sensitive material for diffusion transfer process, in which an image-receiving material sheet is separated from a sensitive material sheet and the former is folded or wound in the form of roll on exposure so that the latter may be not prevented from exposure. After exposure, both materials are contacted, between which a liquid developer is spread to carry out the development. After the treatment for a given time, the sensitive material is separated from the image-receiving material, on which a positive image is obtained.

On the other hand, in an example known as integrated negative and positive type sensitive material for diffusion transfer process, an image-receiving material is contacted to a sensitive material previously to form apparently one sheet. In this case, the image-receiving material is so transparent that may not hinder the exposure of sensitive material, which is exposed through the image-receiving material; or the support of sensitive material is transparent and, when images are observed through the support, only a positive image can be seen because the negative image is covered by the reflection substance from the treatment liquid. Thus, in such photographic material for diffusion transfer process, a positive image is observed without separating the image-receiving material from the sensitive material.

For such integrated negative and positive type photographic material for diffusion transfer process, there are known systems of various kinds of layer constructions other than the system as mentioned above. The processing composition used in the silver salt diffusion transfer photographic process, in which the image-receiving material of this invention is utilized, contains certain ingredients, some of which may be added wholly or in part to the composition during the spreading thereof as by being dissolved into the composition from the photosensitive and/or image-receiving elements, but which are most conveniently introduced therein prior to spreading. The essential ingredients are (a) a silver halide developing agent(s), i.e., a substance capable of reducing the exposed silver halide of the latent image to silver and (b) a silver halide solvent(s), i.e., a substance capable of forming with the unexposed silver halide a silver complex which is soluble in the particular liquid vehicle used for the processing composition.

In the processing composition, any suitable developing agent(s) and silver halide solvent(s) may be employed. Among the developing agents that may be employed are benzene and naphthalene compounds having hydroxyl and amino substituents ortho or para to one another, e.g., hydroquinone, chlorohydroquinone, bromohydroquinone, toluhydroquinone, t-butyl hydroquinone, p-methyl aminophenol sulfate, triaminophenol and pyrogallol.

The silver halide solvent may be selected from any of those known to the art. Particularly useful silver halide solvents include the alkali thiosulfates, e.g., sodium thiosulfate and cyclic amides, e.g., uracil.

Preferably, the processing composition also contains a thickening agent to increase and impart the desired viscosity characteristics. A viscosity of from 1,000 to 200,000 centipoises at a temperature of 20°C has been found satisfactory for permitting the composition to be readily controlled during and after spreading. Illustrative of suitable thickening agents are carbohydrates, e.g., starch; gums, e.g., gum arabic; and plastic materials, e.g., hydroxyethyl cellulose, sodium carboxymethyl cellulose and the sodium salts of polyacrylic and polymethacrylic acids.

Additionally, the composition contains an alkali, e.g., sodium hydroxide and may contain a restrainer, e.g., potassium bromide; a preservative, e.g., sodium sulphite; or other adjuvants as conventionally used in diffusion transfer processes. The developing agent, silver halide solvent and any adjuvant employed, such as a thickener, are used in conventional amounts to achieve the desired effects. This invention relates to an improvement in the production of silver image of high stability and can be applied to all these systems.

This invention will be illustrated more fully by the following examples and controls.

EXAMPLE 1

1. Preparation of Layer (I)

A solution comprising 20 g of the homopolymer of 2-hydroxyethyl methacrylate (Synthesis 1), 200 ml of acetone, 300 ml of water and 0.05 g of 2-imidazolidinethione was coated on the surface of baryta-coated paper (120 g/m², 0.140 mm thickness) so that the dried film thickness might be 5 μ, and then dried. A solution comprising 20 g of cellulose acetate, 50 ml of methanol and 450 ml of methylene chloride was coated thereon so that the dried film thickness might be 4 μ, and then dried.

2. Preparation of image-receiving Material

The support, on which the layer (I) obtained in (1) was formed, was dipped in a hydrolysing bath (35°C) comprising 150 g of glycerine, 0.017 g of nickel nitrate (hexahydrate), 3.1 g of sodium sulphide (nonahydrate), 120 g of sodium hydroxide, 720 ml of methanol and 480 ml of water for 40 seconds, washed with running water for 4 min. and dried. The thickness of hydrolyzed layer was 2.5 μ. The measurement of said hydrolyzed layer was performed by dying with "SUMILITE BLUE FBGL (manufactured by Sumitomo Chemical Industry, Co., Ltd.)", which dyes not cellulose acetate but hydrolyzed cellulose, and observing the section by microscope.

3. Preparation of Silver Halide Sensitive Material (Negative)

A support of paper (100 g/m²) laminated with a polyethylene layer of 20 μ thickness was subjected to Corona discharge to render the surface hydrophilic and then coated with a silver iodobromide photo graphic emulsion (5 mole % AgI). The amount of emulsion coated was 12 mg Ag/100 cm² and 46 mg gelatin/100 cm². An aqueous solution of gelatin was coated thereon as protective layer so that the dried film thickness might be 0.5 $\mu$, and then dried.

4. Development

An imagewise exposed silver halide photographic material and an image-receiving material were contacted face-to-face, between which a treatment liquid comprising 1.6 g of diethyl hydroxyl amine, 0.1 g of zinc chloride, 1.2 g of uracil, 0.72 g of hydroxyethyl cellulose, 3.5 g of potassium hydroxide; $1.5 \times 10^{-3}$ g of ethylene thiourea and 15 ml of water was spread in a thickness of 100 $\mu$. The spread thickness of treatment liquid of 100 $\mu$ was attained by contacting a paper of 100 $\mu$ thick as frame having holes corresponding to image surface to the surface of image-receiving material. After a close contact for 30 sec, both materials were separated.

The resulting positive image had a high maximum transfer density (reflection optical density 1.40) and, when it was stored in an atmosphere at 37.8°C and R. H. 96% for 10 days, there was little discoloration with a considerably reduced fading compared with the following control 1.

EXAMPLE 2

An image-receiving material was prepared and treated in the same manner as in Example 1 to yield a positive image except the use of the copolymer of 2-hydroxyethyl methacrylate and acrylamide obtained in Synthesis 2 instead of the homopolymer of 2-hydroxyethyl methacrylate in Example 1. The result similar to Example 1 was obtained.

EXAMPLE 3

An image-receiving material was prepared and treated in the same manner as in Example 1 to yield a positive image except the use of the homopolymer of 3-hydroxypropyl methacrylate obtained in Synthesis 3 instead of the homopolymer of 2-hydroxy-ethyl methacrylate and the use of 2-mercaptoimidazole instead of 2-imidazolidinethione in Example 1. The result similar to Example 1 was obtained.

EXAMPLE 4

An image-receiving material was prepared and treated in the same manner as in Example 1 to yield a positive image except the use of the copolymer of 2-hydroxyethyl methacrylate and 3-hydroxypropyl methacrylate obtained in Synthesis 4 instead of the homopolymer of 2-hydroxyethyl methacrylate and the use of 1-methyl-2-mercaptoimidazole instead of 2-imidazolidinethione in Example 1. The result similar to Example was obtained.

EXAMPLE 5

An image-receiving material was prepared and treated in the same manner as in Example 1 to yield a positive image except the use of the copolymer of 2-hydroxyethyl methacrylate and methyl methacrylate obtained in Synthesis 5 instead of the homopolymer of 2-hydroxyethyl methacrylate and the use of 4-phenyl-3-mercapto-4H-1,2,4-triazole instead of 2-imidazolidinethione in Example 1. The result similar to Example 1 was obtained.

EXAMPLE 6

An image-receiving material was prepared in the same manner as in Example 1 except that a graft polymer obtained by the graft polymerization of 2-hydroxyethyl methacrylate in hydroxyethyl cellulose solution in Synthesis 6 was used instead of the homopolymer of 2-hydroxyethyl methacrylate and the use of 5-propyl-2-mercaptobenzimidazole instead of 2-imidazolidinethione and the solution after the completion of polymerization was used for coating as it was so that the dried film thickness might be 8 $\mu$. The similar result was obtained in the same transfer test as in Example 1.

EXAMPLE 7

An image-receiving material was prepared and treated in the same manner as in Example 1 to yield a positive image except the use of the graft polymer of gelatine and 2-hydroxyethyl methacrylate obtained in Synthesis 7 instead of the homopolymer of 2-hydroxyethyl methacrylate and the use of 1-phenyl-5-mercaptotetrazole instead of 2-imidazolidinethione in Example 1. The result similar to Example 1 was obtained.

EXAMPLE 8

An image-receiving material was prepared and treated in the same manner as in Example 1 to yield a positive image except the use of the copolymer of 2-hydroxyethyl methacrylate and n-butyl methacrylate in Synthesis 8 instead of the homopolymer of 2-hydroxyethyl methacrylate and the use of 6-lauryl-4-mercapto-1,3,3a,7-tetraazaindene instead of 2-imidazolidinethione in Example 1. The result similar to Example 1 was obtained.

EXAMPLE 9

1. Preparation of Layer (I)

A solution comprising 20 g of the copolymer of 2-hydroxyethyl methacrylate and methyl methacrylate (Synthesis 5), 200 ml of acetone, 300 ml of water and 0.15 g of 5-nitrobenzimidazole was coated on the surface of baryta paper (120 g/m$^2$, 0.140 mm thick) so that the dried film thickness might be 5 $\mu$, and then dried. A solution comprising 3 g of polyvinyl butyral (manufactured by Electric Chemical Industry Co., PVB-3000-4) and 100 ml of methanol was coated thereon so that the dried film thickness might be 0.3 $\mu$, and dried (undercoat layer for coating imagereceiving layer).

2. Preparation of Image-receiving Material

A dispersion solution of silver deposition nuclei comprising 200 ml of water, 60 ml of aqueous dispersion of colloidal silica (manufactured by Nissan Chemical Industry Co., Snowtex C), 1.5 ml of 2% aq. lead acetate ($3H_2O$) solution, 2.3 ml of 3% aq. cadmium acetate ($12H_2O$) solution, 5.0 ml of 5% aq. zinc nitrate ($6H_2O$) solution, 1.0 ml of 3% aq. sodium sulfide ($9H_2O$) solution and 5.0 ml of 6% aq. saponin solution was coated as image-receiving layer on a support, on which the layer (I) obtained in (I) was formed, so that the dried film thickness might be 1.0 $\mu$, and then dried. An aqueous solution of gum arabic was coated thereon as stripping layer so that the coated amount after drying might be 0.4 g/m$^2$, and then dried.

The resulting image-receiving material was treated in the same manner as in Example 1 to yield a positive image thereon. In this case also, the result similar to Example 1 was obtained.

EXAMPLE 10

Integrated Negative and Positive Type Photographic Material

1. Preparation of Layer (I)

A solution comprising 20 g of the homopolymer of 2-hydroxyethyl methacrylate obtained in Synthesis 1, 200 ml of acetone, 300 ml of water and 0.02 g of 6-bromobenzimidazole was coated on the surface of a transparent polyethyleneterephthalate base (100 $\mu$ thick) so that the dried film thickness might be 5 $\mu$, and then dried. An aqueous 5% solution of polyvinyl alcohol (saponification value: 85%) was coated thereon so that the dried film thickness might be 2 $\mu$, and then dried.

2. Preparation of Image-receiving Material

An image-receiving material was prepared in the same manner as in Example 9.

3. Development

The resulting image-receiving material was contacted to the sensitive material described in Example 1 and exposed to light through the transparent image-receiving material. A treatment liquid comprising 1.6 g of diethyl hydroxyl amine, 3.0 g of titanium oxide (manufactured by Ishihara Industries Co., rutile type, mean particle size: 0.5 $\mu$ ), 1.2 g of uracil, 0.72 g of hydroxyethyl cellulose, 3.5 g of potassium hydroxide, $1.5 \times 10^{-3}$ g of 2-imidazolidinethione and 15 ml of water was spread in 100 $\mu$ thick between the two materials. After about 15 sec, only a positive image was observed from the side of support for the image-receiving material. The negative image was covered by the layer of treatment liquid containing white pigment (titanium oxide) so that it may be not observed and it was not necessary to separate both materials. The resulting positive image had a very good storage stability.

CONTROL 1

1. Preparation of Layer (I)

A solution comprising 20 g of cellulose acetate (acetilation value: 55 ± 0.5%, manufactured by Dai-Cell Co.), 0.05 g of 2-imidazolidinethione, 50 ml of methanol and 450 ml of methylene chloride was coated on the surface of baryta-coated paper (120 g/m$^2$, 0.140 mm thick) so that the dried film thickness might be 5 $\mu$, and then dried. A solution comprising 20 g cellulose acetate, 50 ml of methanol and 450 ml of methylene chloride was coated thereon so that the dried film thickness might be 4 $\mu$, and then dried.

2. Preparation of Image-receiving Material and Silver Halide Sensitive material and Development The preparation of image-receiving material and silver halide sensitive material as well as the development were carried out in the same manner as in Example 1.

A positive image having a medium gray shade and a high maximum transfer density (reflection optical density 1.50) was obtained on the image-receiving material. When the image was kept in an atmosphere at 37.8°C and R. H. 97% for 5 days, it was discolored and began to fade.

CONTROL 2

When a known image-receiving material having cellulose acetate layer was used instead of the copolymer layer of 2-hydroxyethyl methacrylate and methyl methacrylate in Example 9, the resulting image showed a bad stability and was apt to be discolored gradually on storage.

CONTROL 3

When a known image-receiving material having cellulose acetate layer was used instead of the homopolymer layer of 2-hydroxyethyl methacrylate in Example 10, the resulting positive image showed a low storage stability.

What is claimed is:

1. An image-receiving material for a silver salt diffusion transfer process comprising (1) a support, (2) on said support a polymer layer containing an imido, mercapto or iodine containing diffusible compound which is a diffusion transfer silver image stabilizer, which can change the property of silver image formed in a binder layer containing silver deposition nuclei, and (3) an alkali permeable and hydrophilic binder layer containing silver deposition nuclei on said polymer layer, said polymer layer comprising at least one water insoluble, alkali permeable hydrophilic polymer selected from the group consisting of homopolymers, copolymers and graft polymers of monoacrylates of polyhydric alcohols and homopolymers, copolymers and graft polymers of monomethacrylates of polyhydric alcohols, and the binder of the binder layer comprising an alkali permeable hydrophilic polymer or an alkali permeable hydrophilic inorganic colloid.

2. An image-receiving material according to claim 1, wherein said water insoluble hydrophilic polymer in the layer (2) is at least one member selected from the group consisting of homopolymers, copolymers and graft polymers of acrylates or methacrylates of alkyleneglycols having 2 – 3 carbon atoms.

3. An image-receiving material according to claim 1, wherein said hydrophilic homopolymers and copolymers have a molecular weight more than 10,000.

4. An image-receiving material according to claim 1, wherein said hydrophilic homopolymers and copolymers have a molecular weight of 50,000 – 60,000.

5. An image-receiving material according to claim 1, wherein said binder in the layer (3) is at least one member selected from the group consisting of film-forming hydrophilic organic and inorganic colloid substances.

6. An image-receiving material according to claim 1, wherein the thickness of said layer (2) is about 0.1 to 20 microns and the thickness of said layer (3) is about 0.1 to 20 $\mu$.

7. An image-receiving material according to claim 6, wherein a compound which is diffusible and can change the property of silver image is added in an amount of $10^{-6}$ to $10^{-2}$ mol/m$^2$ to said layer (2).

8. An image-receiving material according to claim 7, wherein said compound which is diffusible and can change the property of silver image is at least one selected from the group consisting of mercapto, imino and iodine compounds.

9. An image-receiving material according to claim 6, wherein said layer (3) contains $10^{-9}$ to $10^{-6}$ g/cm$^2$ of silver deposition nuclei.

10. An image-receiving material according to claim 6, wherein an alkali-permeable polymer-layer is provided between said layers (2) and (3).

11. An image-receiving material according to claim 1, wherein said material is a peal apart type sensitive material for diffusion transfer process.

12. An image-receiving material according to claim 1, wherein said material is an integrated negative and positive type sensitive material for diffusion transfer process.

13. An image-receiving material according to claim 1 wherein the water insoluble hydrophilic polymer in layer (2) is a hydroxyethyl methacrylate polymer or a hydroxypropyl methacrylate polymer.

14. An image-receiving material according to claim 13 wherein the water insoluble hydrophilic polymer in layer (2) is a hydroxyethyl methacrylate polymer.

* * * * *